US007797835B2

(12) United States Patent
Zeng

(10) Patent No.: US 7,797,835 B2
(45) Date of Patent: Sep. 21, 2010

(54) FOLDABLE KNIFE WITH DISPOSABLE BLADES

(76) Inventor: Min Zheng Zeng, No. 72, Chaoguei Rd., Situn District, Taichung City 407 (TW)

( * ) Notice: Subject to any disclaimer, the term of this patent is extended or adjusted under 35 U.S.C. 154(b) by 346 days.

(21) Appl. No.: 12/027,994

(22) Filed: Feb. 7, 2008

(65) Prior Publication Data

US 2009/0199408 A1 Aug. 13, 2009

(51) Int. Cl.
*B26B 1/04* (2006.01)

(52) U.S. Cl. ..... 30/153; 30/162

(58) Field of Classification Search ..... 30/151, 30/153, 154, 155, 156, 160, 161, 162, 164
See application file for complete search history.

(56) References Cited

U.S. PATENT DOCUMENTS 5,890,294 A * 4/1999 Keklak et al. ..... 30/161
7,480,997 B2 * 1/2009 Ping ..... 30/161
2003/0150116 A1 * 8/2003 Scala ..... 30/160
2008/0282546 A2 * 11/2008 Ranieri et al. ..... 30/162

* cited by examiner

*Primary Examiner*—Stephen Choi
(74) *Attorney, Agent, or Firm*—Banger Shia

(57) ABSTRACT

A foldable knife includes a handle, a frame pivotally connected to the handle, a cartridge pivotally connected to the frame, a leaf spring attached to the frame, a blade-driving device, a blade-positioning element and a button. The frame includes a slot. The cartridge includes a slot through which the leaf spring reaches at least one blade when the cartridge is disposed in the frame. The blade-driving device includes a plate and a switch. The plate is in firm contact with the blade. The switch includes a portion located outside the frame and another portion inserted through the slot of the frame and connected to the plate. A blade-positioning element is movably connected to the frame. A button includes a portion for pushing the blade-positioning element and another portion inserted through the aperture of the frame for contact with a user's finger.

10 Claims, 8 Drawing Sheets

FOLDABLE KNIFE WITH DISPOSABLE BLADES

BACKGROUND OF INVENTION

1. Field of Invention

The present invention relates to a knife and, more particularly, to a foldable knife with at least one disposable blade.

2. Related Prior Art

Knives are used to cut thin wood and acrylic boards in the decoration of our dwellings. A typical knife for such use includes a handle and a blade formed with two cutting tips. The blade is connected to the handle and used to cut the thin wood and acrylic boards. When the blade becomes blunt after some time of use, it is disconnected from the handle and disposed of so that a new blade can be connected to the handle for use. Thus, the knife is always equipped with a sharp blade.

The typical knife includes a cartridge located in the handle. Before use, at least one blade is inserted in the cartridge. In use, the blade is pushed from the cartridge so that one of the cutting tips thereof is exposed from the handle. To ensure the smooth extension and reliable operation of the blade, the handle is made of a length based on the maximum displacement of the cartridge and the maximum displacement of the blade. However, it might be inconvenient to carry a long handle. There must be a balance between the smooth extension and reliable operation of the blade and the convenient carrying of the knife during the consideration of the length of the handle.

Therefore, the present invention is intended to obviate or at least alleviate the problems encountered in prior art.

SUMMARY OF INVENTION

It is the first objective of the present invention to provide a foldable knife for connection to at least one disposable blade.

To achieve the foregoing objective, the foldable knife includes a handle, a frame pivotally connected to the handle, a cartridge pivotally connected to the frame, a leaf spring attached to the frame, a blade-driving device, a blade-positioning element and a button. The frame includes a slot. The cartridge includes a slot through which the leaf spring reaches at least one blade when the cartridge is disposed in the frame. The blade-driving device includes a plate and a switch. The plate is in firm contact with the blade. The switch includes a portion located outside the frame and another portion inserted through the slot of the frame and connected to the plate. A blade-positioning element is movably connected to the frame. A button includes a portion for pushing the blade-positioning element and another portion inserted through the aperture of the frame for contact with a user's finger.

Other objectives, advantages and features of the present invention will become apparent from the following description referring to the attached drawings.

BRIEF DESCRIPTION OF DRAWINGS

The present invention will be described via the detailed illustration of the preferred embodiment referring to the drawings.

DETAILED DESCRIPTION OF PREFERRED EMBODIMENT

Figure 1:
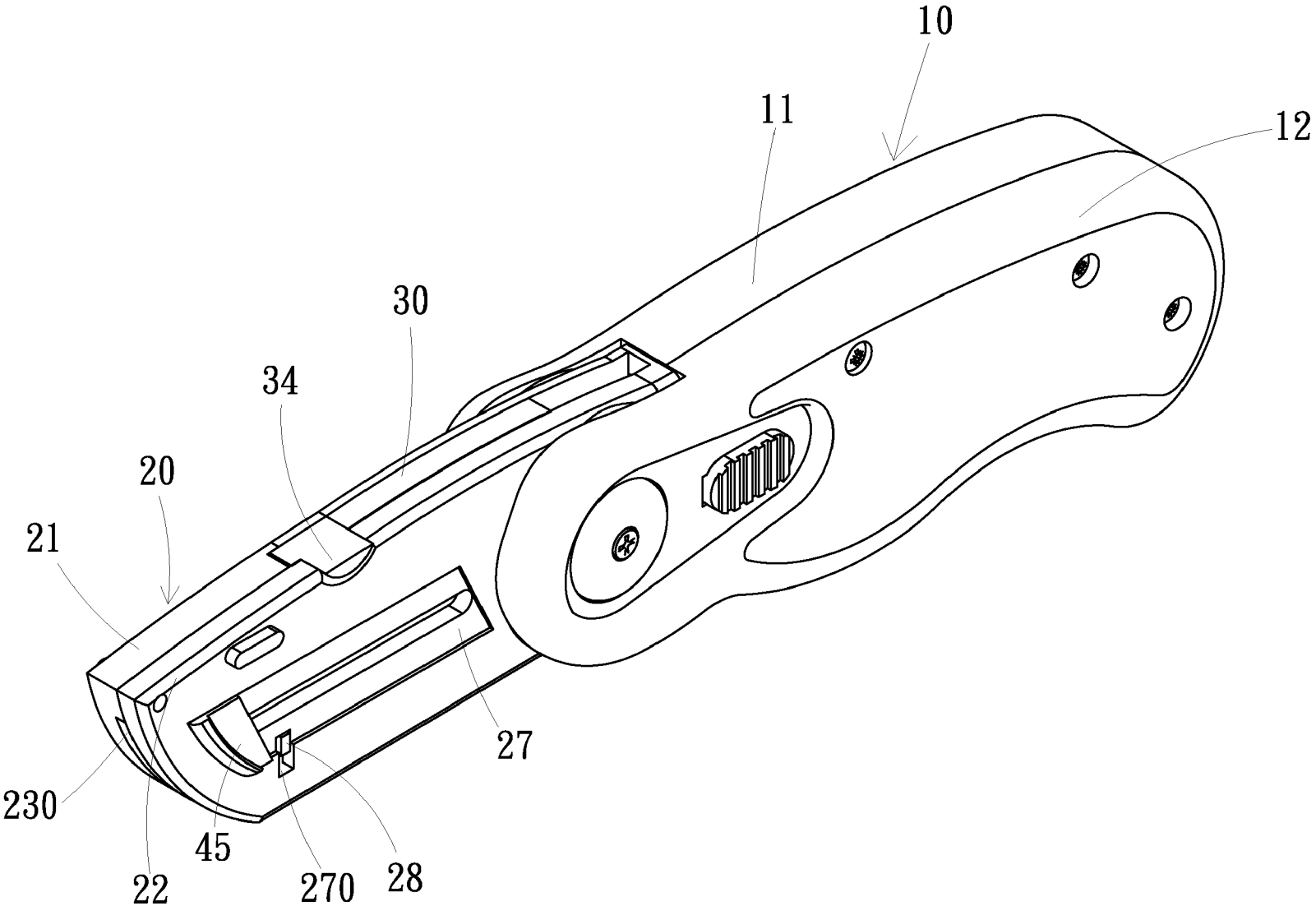
FIG. 1 is a perspective view of a foldable knife according to the preferred embodiment of the present invention.

Referring to FIG. 1, a foldable knife includes a handle 10, a frame 20 pivotally connected to the handle 10, a cartridge 30 pivotally connected to the frame 20 and a blade-driving device movably according to the preferred embodiment of the present invention.

Figure 2:
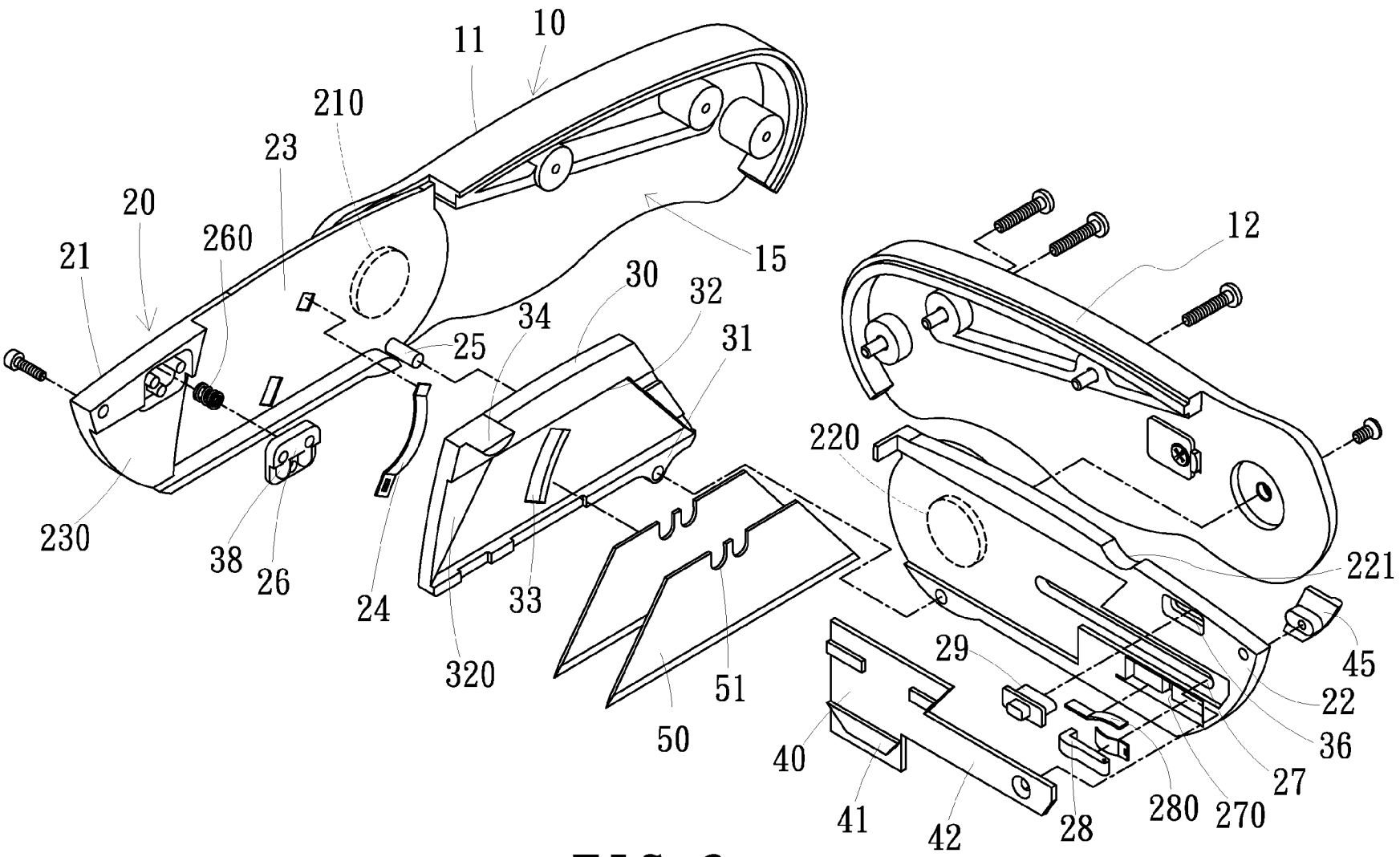
FIG. 2 is an exploded view of the foldable knife shown in FIG. 1.
Figure 3:
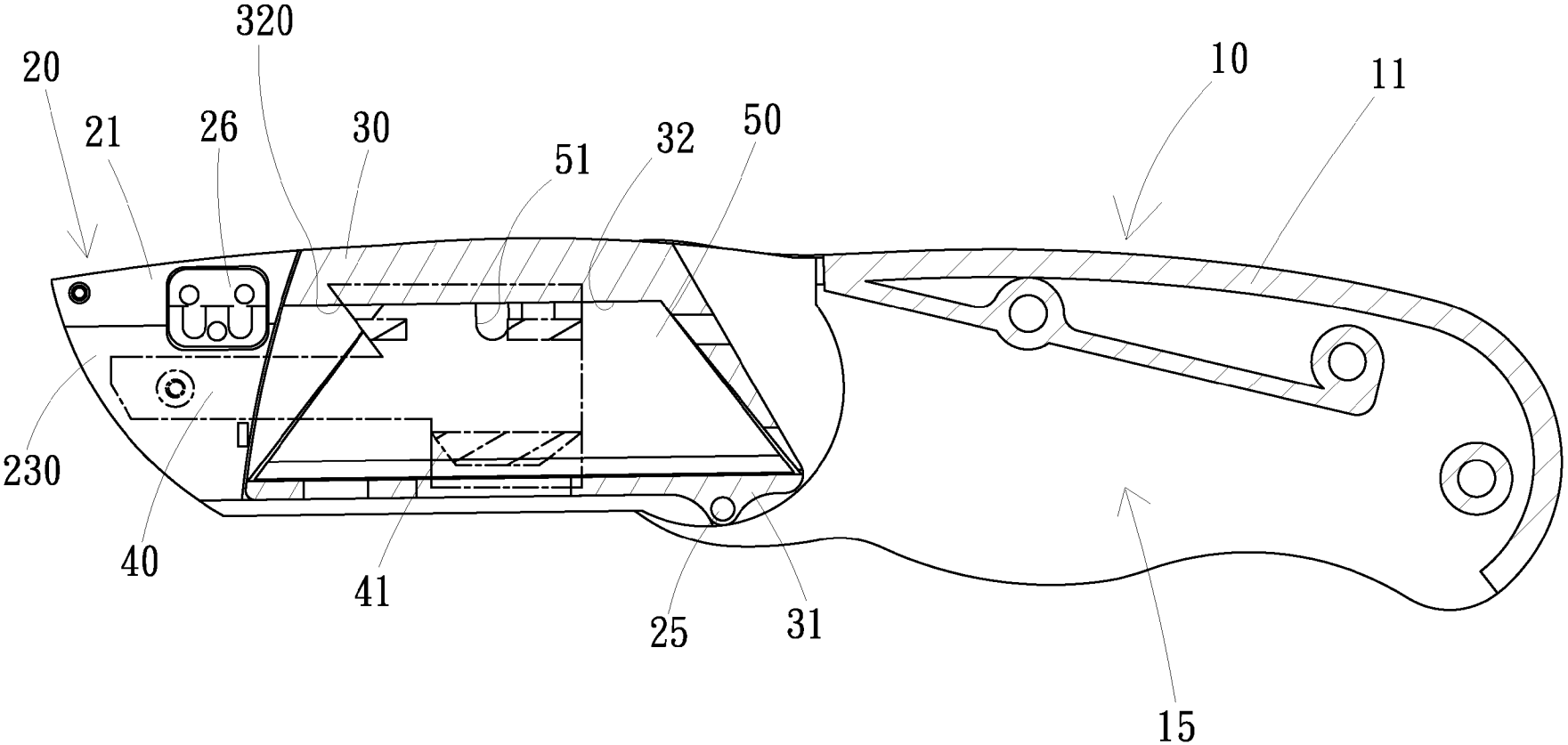
FIG. 3 is a cross-sectional view of the foldable knife shown in FIG. 1.

Referring to FIGS. 2 and 3, the handle 10 includes two halves 11 and 12 joined together. There is an open space 15 defined in the handle 10, i.e., between the halves 11 and 12. Each of the halves 11 and 12 of the handle 10 includes a cavity defined in an internal side.

The frame 20 includes two covers 21 and 22 joined together. The cover 21 includes a pivot 210 formed on an external side. The cover 22 includes a pivot 220 formed on an external side. The pivots 210 and 220 are disposed in the cavities of the halves 11 and 12 of the handle 10, thus pivotally connecting the frame 20 to the handle 10. The frame 20 can be pivoted into the open space 15 of the handle 10.

The cover 21 includes an open space 23 defined in an internal side and a mouth 230 in communication with the open space 23. The open space 23 is deeper than the mouth 230. A leaf spring 24 is attached to the internal side of the cover 21. An axle 25 is formed on the internal side of the cover 21. A blade-positioning element 26 is attached to the internal side of the cover 21 movably. A spring 260 is compressed between the cover 21 and the blade-positioning element 26. The blade-positioning element 26 is formed with two ribs 38.

A cutout 221 is defined in an edge of the cover 22. The cover 22 includes a slot 27 longitudinally defined therein, an aperture 270 defined therein, and an aperture 36 defined therein. A switch-restraining element 28 includes a first portion pivotally connected to the cover 22 and a second portion exposed from the frame 20 through the aperture 270. A spring 280 is used to keep the second portion of the switch-restraining element 28 exposed from the frame 20. A button 29 includes a first portion in contact with the blade-positioning element 26 in the frame 20 and a second portion inserted exposed from the frame 20 through the aperture 36 for contact with a user's finger.

The cartridge 30 includes a lug 31 formed thereon, an open space 32 defined in a side, a mouth 320 in communication with the open space 32, a slot 33 in communication with the open space 32 and a tab 34 extended from the side, next to the open space 32. The open space 32 is deep enough for receiving at least one and preferably two blades 50. The lug 31 is pivotally mounted on the axle 25 so that the cartridge 30 is pivotally connected to the frame 20. The cartridge 30 can be pivoted into the open space 23 of the frame 20 so that the tab 34 is disposed into the cutout 221. The leaf spring 24 is inserted into the open space 32 through the slot 33.

The blade-driving device includes a plate 40 and a switch 45. The plate 40 includes contacts 41 formed on a side and a connective portion 42 extended from an end. The plate 40 is movably disposed in the frame 20. The switch 45 includes a first portion located outside the frame 20 and a second portion inserted into the open space 23 through the slot 27. The second portion of the switch 45 is connected to the connective portion 42 of the plate 40 so that the switch 45 is operable to move the plate 40.

Each of the blades 50 includes two cutting tips and two cutouts 51 defined in an edge.

Figure 4:
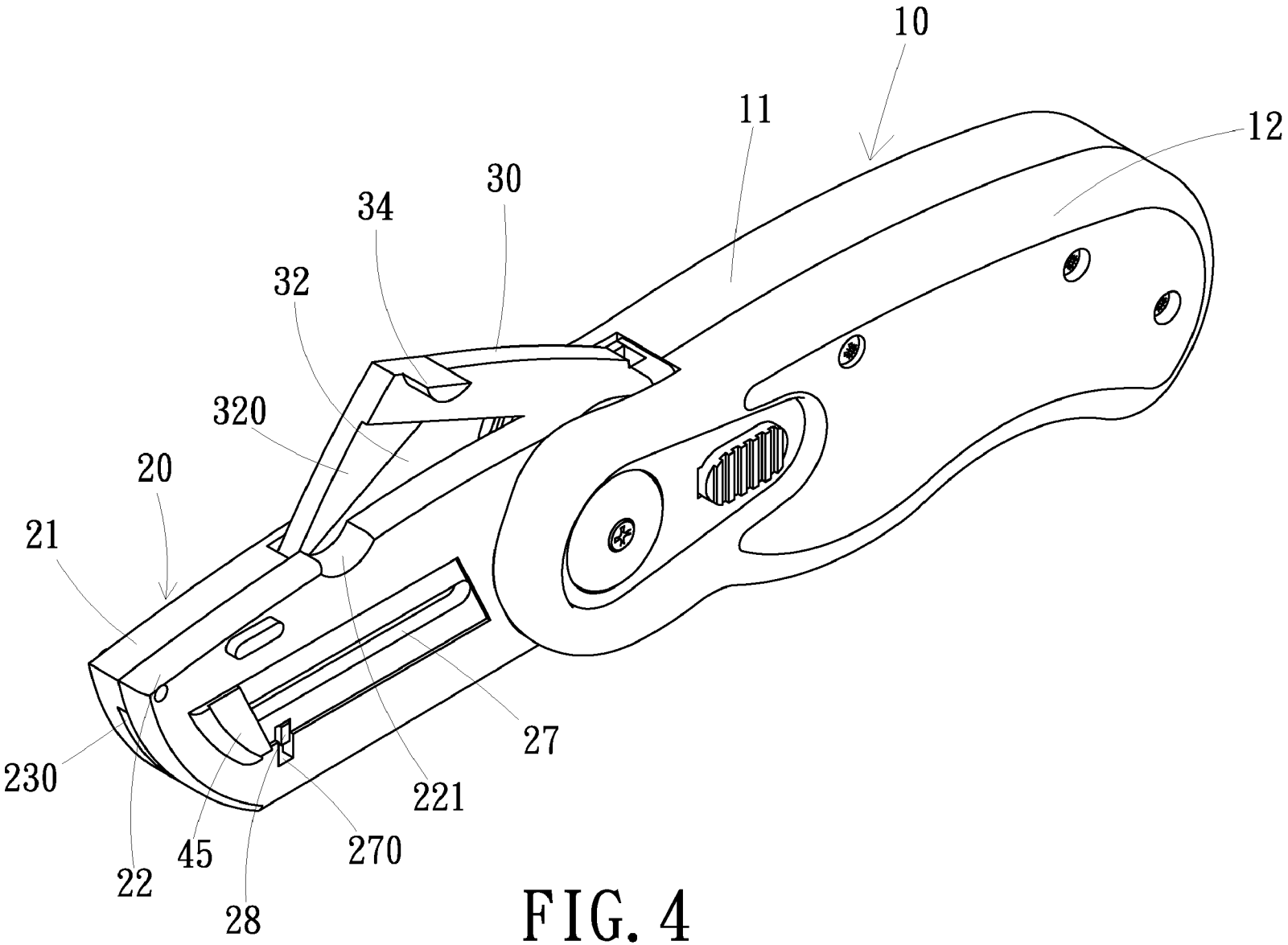
FIG. 4 is a perspective view of the foldable knife in another position than shown in FIG. 1.
Figure 5:
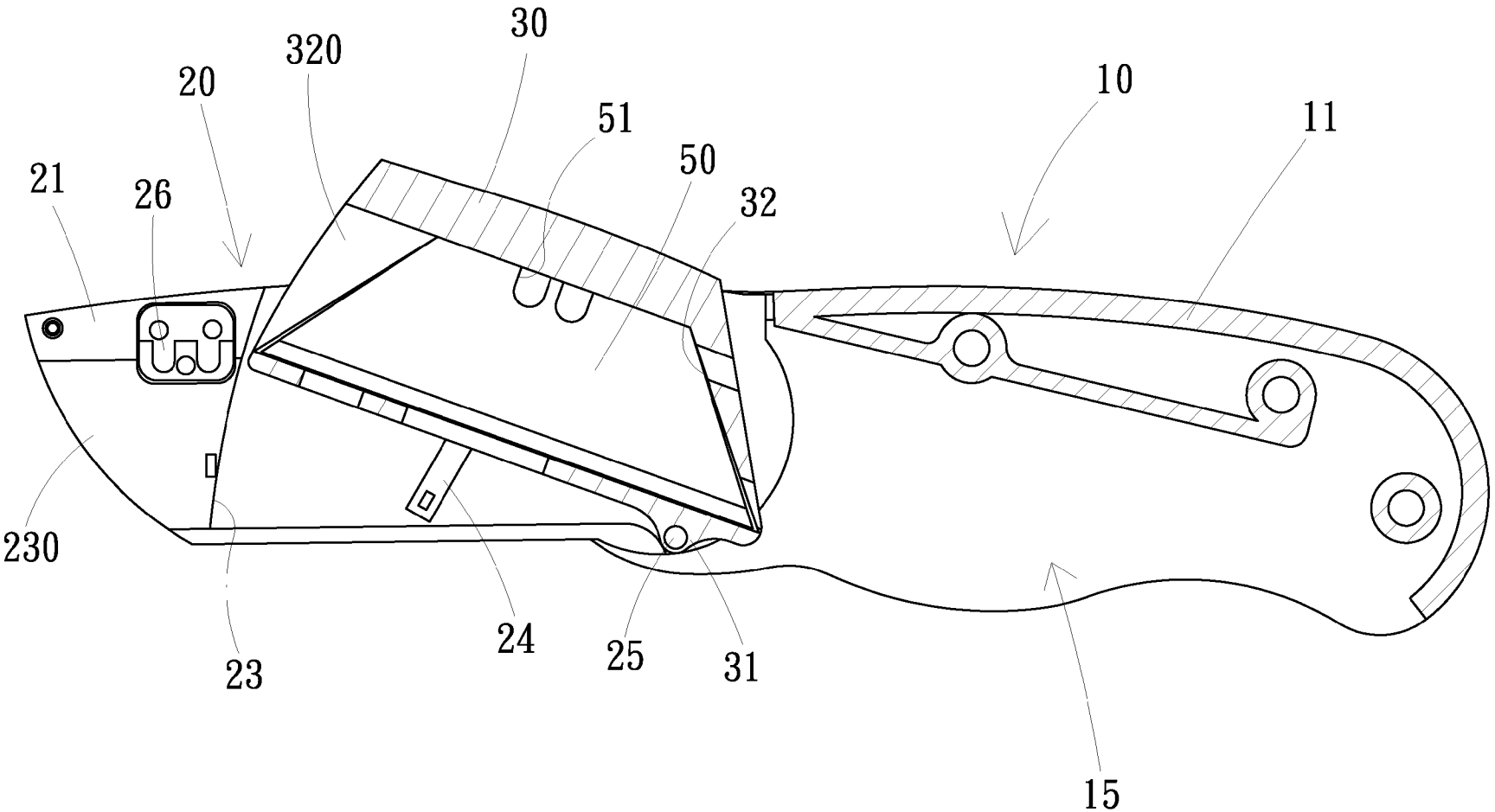
FIG. 5 is a cross-sectional view of the foldable knife shown in FIG. 4.

Referring to FIGS. 4 and 5, the frame 20 is substantially pivoted out of the open space 15 of the handle 10. The cartridge 30 is partially pivoted from the open space 23 of the frame 20. The blades 50 can be inserted into the open space 32 of the cartridge 30 through the mouth 320.

Figure 6:
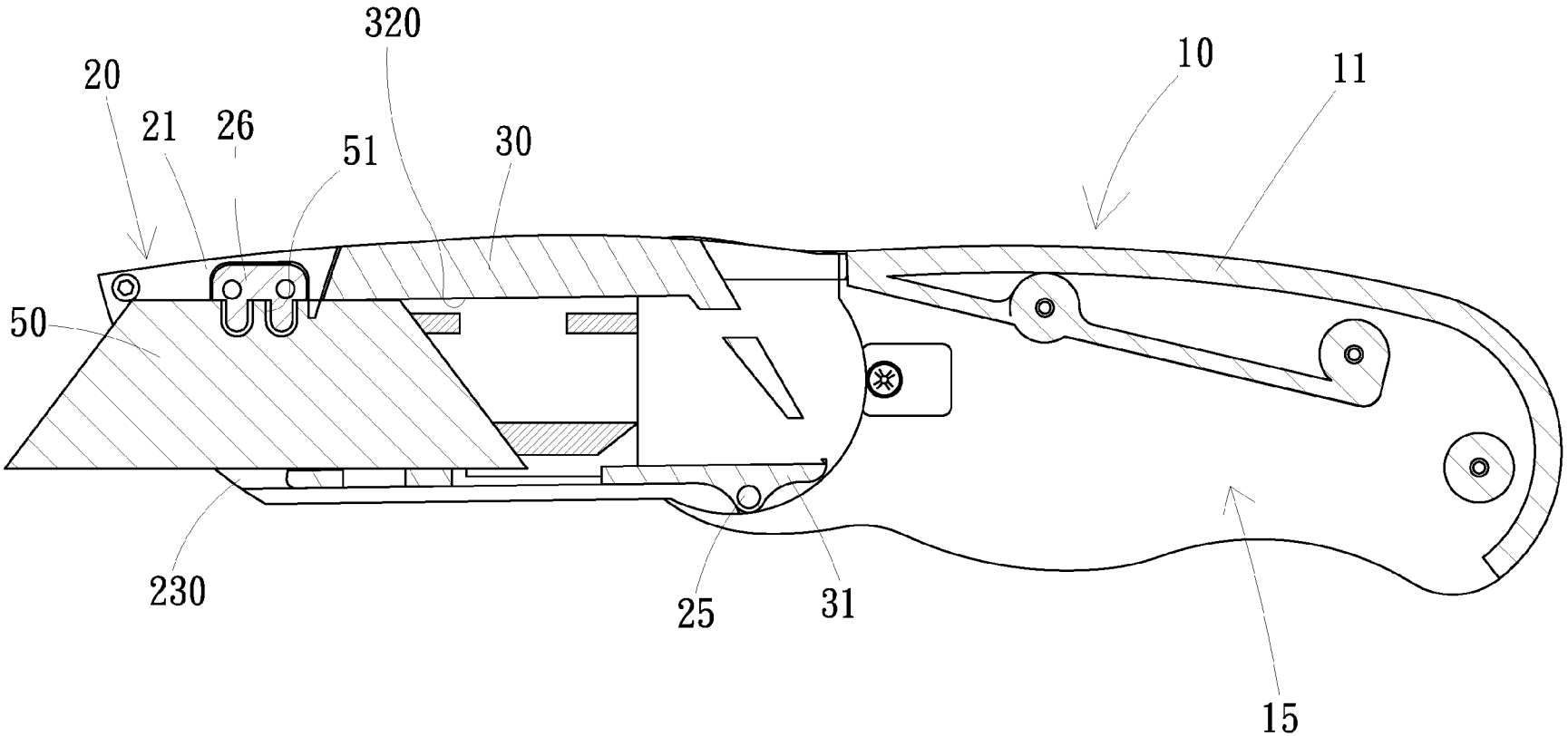
FIG. 6 is a cross-sectional view of the foldable knife in another position than shown in FIG. 5.
Figure 7:
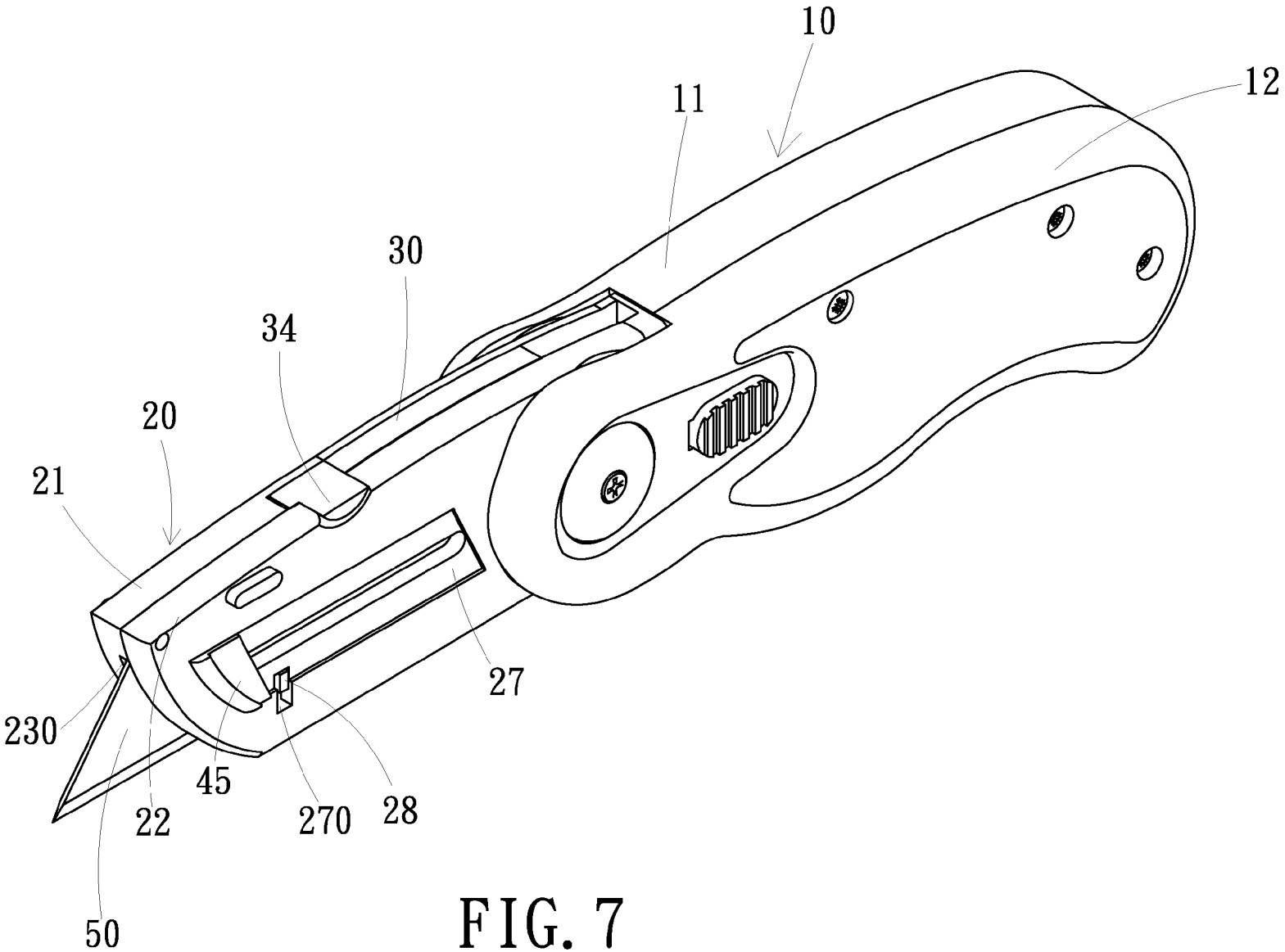
FIG. 7 is a perspective view of the foldable knife shown in FIG. 6.

Referring to FIGS. 6 and 7, the cartridge 30 is pivoted into the open space 23 of the frame 20. The mouth 320 of the cartridge 30 is aligned to the mouth 230 of the frame 20. The contacts 41 contact one of the blades 50 ("active blade 50") while the leaf spring 24 pushes the other blade 50 ("spare blade 50"). Thus, the active blade 50 is in firm contact with the contacts 41. When the switch 45 is moved, the active blade 50 will be partially extended from the frame 20 because of friction between the contacts 41 and the active blade 50. When the switch 45 is located near an end of the slot 27, the switch 45 will be restrained in the position by the second portion of the switch-restraining element 28 referring to FIG. 1.

When the button 29 is pushed, the ribs 38 of the blade-positioning element 26 will be moved out of the cutouts 51 of the active blade 50. Then, the second portion of the switch-restraining element 28 is pushed into the aperture 270. Finally, the switch 45 can be moved, thus returning the active blade 50 into the frame 20.

Figure 8:
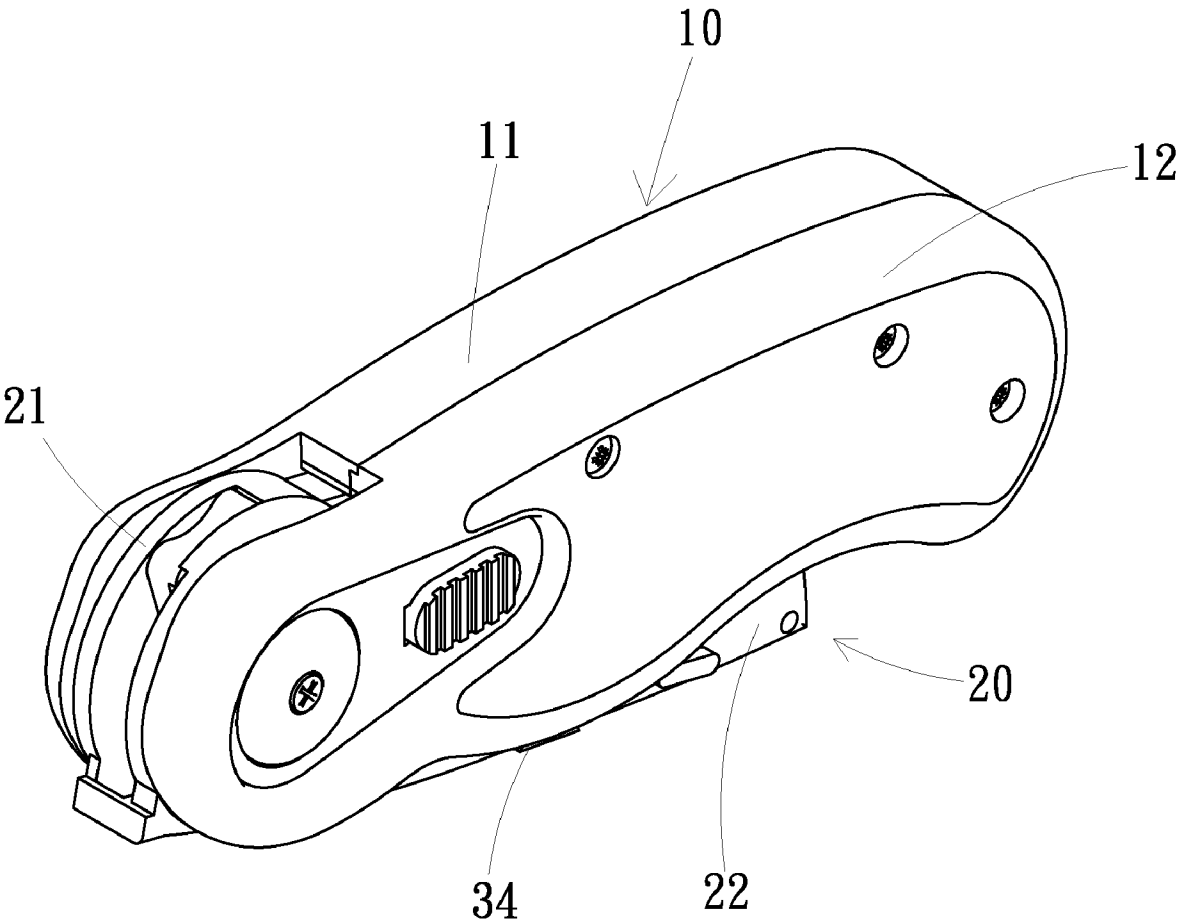
FIG. 8 is a perspective view of the foldable knife in another position than shown in FIG. 1.

Referring to FIG. 8, the foldable knife is folded, thus reducing the length thereof for convenient storage and carrying.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A foldable knife comprising:

a handle;

a frame pivotally connected to the handle and formed with a slot defined therein and an aperture defined therein;

a leaf spring attached to the frame;

a cartridge pivotally connected to the frame and formed with a slot through which the leaf spring reaches at least one blade when the cartridge is disposed in the frame; and a blade-driving device comprising:

a plate in firm contact with the blade against the leaf spring; and a switch comprising a portion located outside the frame and another portion inserted through the slot of the frame and connected to the plate;

a blade-positioning element movably connected to the frame; and a button comprising a portion for pushing the blade-positioning element and another portion inserted through the aperture of the frame for contact with a user's finger.

2. The knife according to claim 1, wherein the frame comprises two pivots inserted into an internal side of the handle, thus pivotally connecting the frame to the handle.

3. The knife according to claim 1, wherein the cartridge comprises a lug formed on an edge, and the frame comprises an axle inserted in the lug, thus pivotally connecting the cartridge to the frame.

4. The knife according to claim 1, wherein the plate comprises a connective portion connected to the switch.

5. The knife according to claim 1, wherein the cartridge comprises a tab operable for pivoting the cartridge.

6. The knife according to claim 5, wherein the frame comprises a cutout for receiving the tab.

7. The knife according to claim 1, wherein the plate comprises at least one contact in firm contact with the blade against the leaf spring.

8. The knife according to claim 1, wherein the blade-positioning element comprises at least one rib for insertion into at least one cutout defined in the blade, thus positioning the blade.

9. The knife according to claim 1 comprising a switch-restraining element formed with a portion pivotally connected to the frame and another portion exposed from the frame for restraining the switch.

10. The knife according to claim 9 comprising a spring for keeping the switch-restraining element partially exposed from the frame.

* * * * *